US010815052B2

(12) United States Patent
Chai et al.

(10) Patent No.: US 10,815,052 B2
(45) Date of Patent: Oct. 27, 2020

(54) LIQUID-STABILIZING APPARATUS FOR LIQUID CARGO TANK

(71) Applicant: WISON(NANTONG) HEAVY INDUSTRY CO., LTD., Nantong (CN)

(72) Inventors: Song Chai, Nantong (CN); Xiaocheng Dong, Nantong (CN); Xinhua Mao, Nantong (CN); Wenxin An, Nantong (CN); Huaqing Wei, Nantong (CN); Jianrong Shen, Nantong (CN); Qizhong Chen, Nantong (CN)

( * ) Notice: Subject to any disclaimer, the term of this patent is extended or adjusted under 35 U.S.C. 154(b) by 0 days.

(21) Appl. No.: 16/148,389

(22) Filed: Oct. 1, 2018

(65) Prior Publication Data

US 2019/0031435 A1 Jan. 31, 2019

Related U.S. Application Data

(63) Continuation of application No. PCT/CN2016/102213, filed on Oct. 14, 2016.

(30) Foreign Application Priority Data

Apr. 1, 2016 (CN) ..... 2016 1 0198679

(51) Int. Cl.

| | |
|---|---|
| ***B65D 90/52*** | (2006.01) |
| ***B63B 25/12*** | (2006.01) |
| ***B63B 39/00*** | (2006.01) |
| ***F17C 13/00*** | (2006.01) |

(52) U.S. Cl.

CPC ..... *B65D 90/52* (2013.01); *B63B 25/12* (2013.01); *B63B 39/00* (2013.01); *F17C 13/004* (2013.01);

(Continued)

(58) Field of Classification Search

CPC ..... B65D 90/52; B65D 88/34; B65D 37/32; B60K 15/077; B60K 2015/0344;

(Continued)

(56) References Cited

U.S. PATENT DOCUMENTS 5,398,840 A * 3/1995 Luhman ..... B32B 5/26 210/508
2009/0078705 A1* 3/2009 Ramsay ..... B60K 15/077 220/562

(Continued)

FOREIGN PATENT DOCUMENTS

CN 202011468 U 10/2011
CN 203268291 U 11/2013

(Continued)

OTHER PUBLICATIONS

CN202011468_translation.pdf.*

(Continued)

*Primary Examiner* — Allan D Stevens
(74) *Attorney, Agent, or Firm* — Erson IP (Nelson IP)

(57) ABSTRACT

A liquid-stabilizing apparatus for a liquid cargo tank includes a guide structure. The guide structure is provided with a positioning floating body. The positioning floating body is provided with anti-sloshing members. The anti-sloshing members are provided with discontinuous baffles at a fixed angle. By using the liquid-stabilizing apparatus, the liquid cargo tank is no longer required to have a bevel surface structure, thereby increasing load capacity of the liquid cargo tank and preventing the liquid cargo tank in various loading states from being impacted by liquid cargos.

7 Claims, 5 Drawing Sheets

(52) U.S. Cl.
CPC ..... *F17C 2201/0157* (2013.01); *F17C 2201/052* (2013.01); *F17C 2221/033* (2013.01); *F17C 2221/035* (2013.01); *F17C 2223/0153* (2013.01); *F17C 2223/0161* (2013.01); *F17C 2223/033* (2013.01); *F17C 2260/016* (2013.01); *F17C 2270/0105* (2013.01)

(58) Field of Classification Search
CPC .... B60K 2015/0772; B60K 2015/0775; B60K 2015/0777; B63B 25/12; B63B 25/16; F17C 2260/016; A47G 2200/02; B64D 37/32
USPC ..... 220/563, 734
See application file for complete search history.

(56) References Cited

U.S. PATENT DOCUMENTS

2013/0112693 A1* 5/2013 Shin ..... B63B 25/08 220/563
2016/0096428 A1* 4/2016 Vaishnav ..... B60K 15/073 220/563
2016/0318708 A1* 11/2016 Kim ..... B65D 90/52

FOREIGN PATENT DOCUMENTS

| | | | | | |
|---|---|---|---|---|---|
| CN | 103492261 | A | | 1/2014 | |
| CN | 105711757 | A | | 6/2016 | |
| CN | 205707179 | U | | 11/2016 | |
| DE | 1755901 | A1 | * | 11/1971 | ..... B60K 15/03 |
| GB | 538467 | A | * | 8/1941 | ..... C10K 1/024 |
| JP | 53008813 | A | * | 1/1978 | ..... B65D 90/52 |
| JP | 2012066840 | A | | 4/2012 | |
| JP | 5331388 | B2 | * | 10/2013 | ..... B60K 15/077 |
| WO | WO-2012144641 | A1 | * | 10/2012 | ..... B63B 25/12 |

OTHER PUBLICATIONS

WO2012144641_translation.pdf.*
Internation Search Report of PCT/CN2016/102213, dated Jan. 20, 2017.

* cited by examiner

LIQUID-STABILIZING APPARATUS FOR LIQUID CARGO TANK

CROSS-REFERENCE TO RELATED APPLICATIONS

This application is a continuation of International Patent Application No. PCT/CN2016/102213 with a filing date of Oct. 14, 2016, designating the United States, now pending, and further claims priority to Chinese Patent Application No. 201610198679.9 with a filing date of Apr. 1, 2016. The content of the aforementioned applications, including any intervening amendments thereto, are incorporated herein by reference.

TECHNICAL FIELD

The present disclosure relates to a liquid-stabilizing apparatus, and particularly to a liquid-stabilizing apparatus for a liquid cargo tank. The apparatus is installed in a cargo tank of a ship for transporting or containing liquid cargos, and is used to reduce impact force generated by sloshing of the liquid cargo such as liquefied natural gas or liquefied petroleum gas.

BACKGROUND OF THE PRESENT INVENTION

Liquefied natural gas is obtained by cooling natural gas to extremely low temperatures (about −163° C.). Because the volume of the liquefied gas is only about 1/600 of the volume of gaseous natural gas, the liquefied gas is very suitable for long-distance marine transportation.

A liquefied gas transporting ship designed to transport the liquefied gas across the sea and transport the liquefied gas to desired location on land or a liquefied gas floating regasification storage device designed to transport the liquefied gas across the sea to desired location on land and to regasify the liquefied gas for use on land are both equipped with a storage tank or liquid cargo tank. The liquid cargo tank can withstand the low-temperature state of the liquefied gas.

If the ship equipped with the liquid cargo tank moves during navigation or anchorage, the liquid in the liquid cargo tank also moves, causing sloshing impact on the top wall and the side wall of the liquid cargo tank. Due to the sloshing impact, the structure and the heat insulating material of the liquid cargo tank may be damaged.

Sloshing refers to the movement of the liquid in the liquid cargo tank caused by the movement of the ship or a floating structure in various marine transportation conditions. If the liquid is only loaded in part of the liquid cargo tank, the sloshing caused by the movement of the liquid may severely impact the side wall and the ceiling of the cargo tank. This is called sloshing impact.

FIG. 1 is a sectional three-dimensional diagram illustrating a conventional liquid cargo tank designed to reduce the sloshing impact.

Referring to FIG. 1, in traditional design, the sloshing is reduced by a technology of forming an upper bevel and a lower bevel which are oblique at about 45° at the upper side and the lower side of the transverse side wall of the cargo tank. The bevels are formed as mentioned above at the liquid cargo tank to change the shape of the cargo tank, so as to reduce sloshing load to a certain degree.

However, as shown in FIG. 1, the technology of forming the bevels at the liquid cargo tank plays a role of reducing the sloshing impact only under some specific loading states.

Therefore, another method is required to achieve a liquid cargo tank capable of safely withstanding the sloshing impact load under various loading states.

In addition, under the above condition that the bevels are formed to reduce the sloshing impact, a storage space in the cargo tank is reduced due to the existence of the bevels and the storage capability of the cargo tank for the cargo is also reduced.

Especially, for the liquid cargo tank that loads the liquefied natural gas or liquefied petroleum gas, to satisfy the heat preservation need for low-temperature liquid, the inner bulkhead of the cargo tank is usually made of special low-temperature resistant material through a complex process. Thus, design of an anti-sloshing apparatus shall minimize modification and processing related to the bulkhead.

SUMMARY OF PRESENT INVENTION

The technical problem to be solved in the present disclosure is to provide an apparatus for reducing sloshing impact. The apparatus is capable of enabling a liquid cargo tank to safely withstand the sloshing impact under various loading states. Meanwhile, the apparatus can effectively reduce the sloshing impact by eliminating the use of conventional bevels in the liquid cargo tank, and more cargo can be loaded than the same level of liquid cargo tanks.

To solve the above technical problem, a liquid-stabilizing apparatus for a liquid cargo tank in the present disclosure includes a guide structure, wherein the guide structure is provided with a positioning floating body; the positioning floating body is provided with anti-sloshing members; and the anti-sloshing members are provided with discontinuous baffles at a fixed angle.

In a further improvement solution of the above technical problem, the positioning floating body can move up and down on the guide structure.

In a further improvement solution of the above technical problem, the anti-sloshing members are disposed on two sides of the positioning floating body; and the anti-sloshing members are perpendicular to the guide structure.

In a further improvement solution of the above technical problem, the discontinuous baffles and the anti-sloshing members are disposed in the same horizontal plane.

In a further improvement solution of the above technical problem, the positioning floating body is made of metal or fiberglass.

In a further improvement solution of the above technical problem, the guide structure is a rectangular column.

In a further improvement solution of the above technical problem, the discontinuous baffles are arranged with a same spacing.

In a further improvement solution of the above technical problem, the fixed angle is 25-65 degrees.

The liquid-stabilizing apparatus in the present disclosure has two advantages compared with the existing apparatus: first, the liquid cargo tank does not use bevel structure, thereby increasing the loading capacity of the liquid cargo tank; and second, the impact caused by liquid cargo on the liquid cargo tank may be avoided in various loading states.

DETAILED DESCRIPTION OF PREFERRED EMBODIMENTS

Exemplary embodiments of the present disclosure will be described below in detail with reference to drawings.

The liquid-stabilizing apparatus according to the present disclosure is suitable for any tank that contains liquefied natural gas. To facilitate description, the application of the liquid-stabilizing apparatus in a conventional membrane cargo tank will be illustrated.

The liquid-stabilizing apparatus for use in the liquid cargo tank according to the present disclosure is provided with a positioning floating body 10 and a guide structure 11. The positioning floating body 10 has buoyancy so that this member produces resistance against movement of liquid cargo while correspondingly moving along with the movement of the liquid cargo caused by the movement of the ship. The guide structure 11 not only enables the positioning floating body 10 to float with the liquid, but also restricts the rotation of anti-sloshing members 12, so as to ensure that the anti-sloshing members 12 keep a perpendicular relationship with the side wall of the cargo tank when the cargo tank is inclined, to inhibit sloshing of the liquid at an effective angle. Embodiments of the present disclosure are described below in detail.

Figure 1:
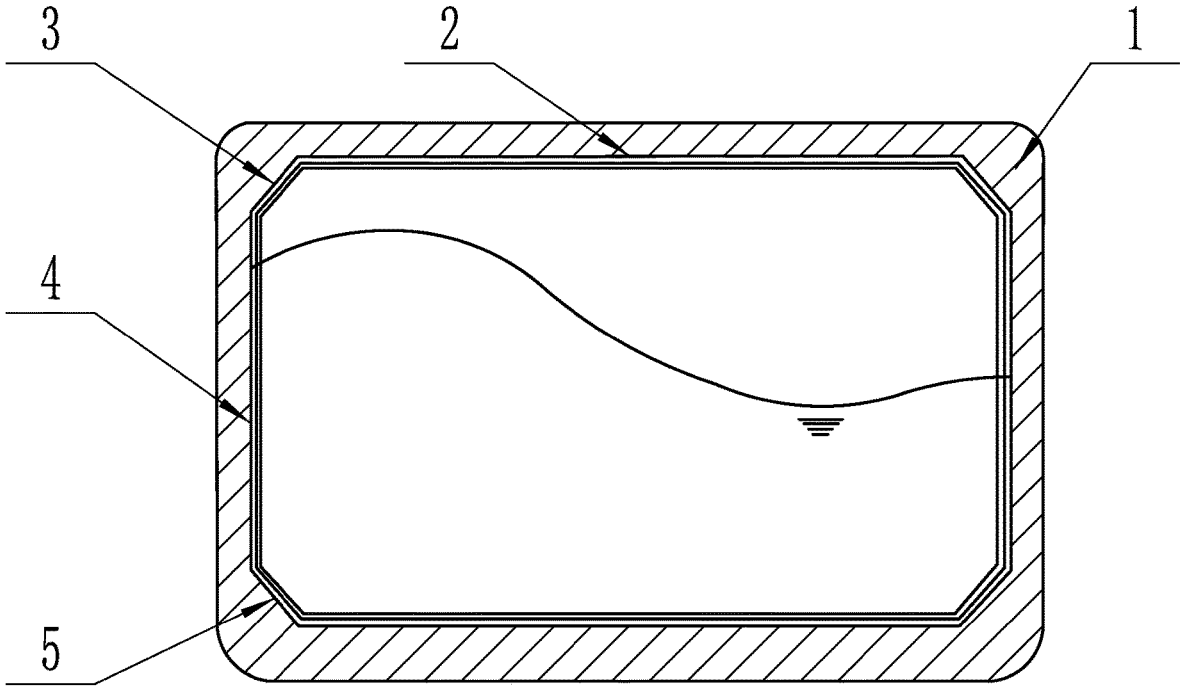
FIG.1 of Prior Art
FIG. 1 is a sectional view of a conventional liquid cargo tank in the prior art, wherein 1—cargo tank; 2—top wall; 3—upper bevel; 4—side wall; and 5—lower bevel.
Figure 2:
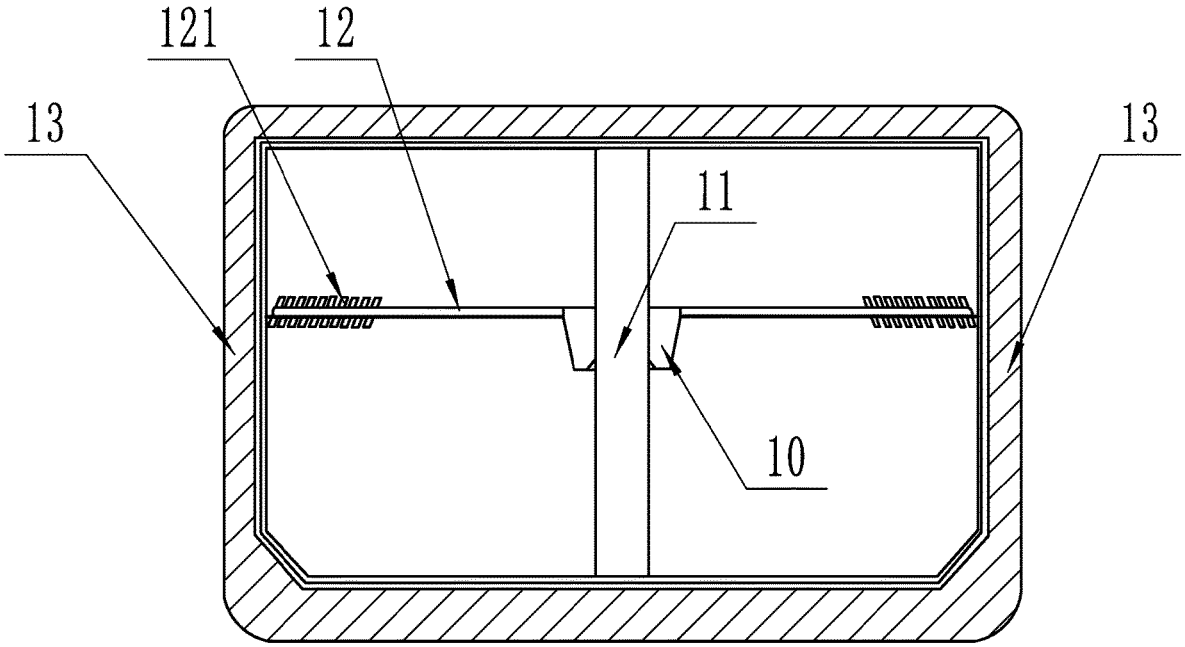
FIG. 2 is a front sectional view showing a liquid-stabilizing apparatus according to the present disclosure installed in a liquid cargo tank.
Figure 3:
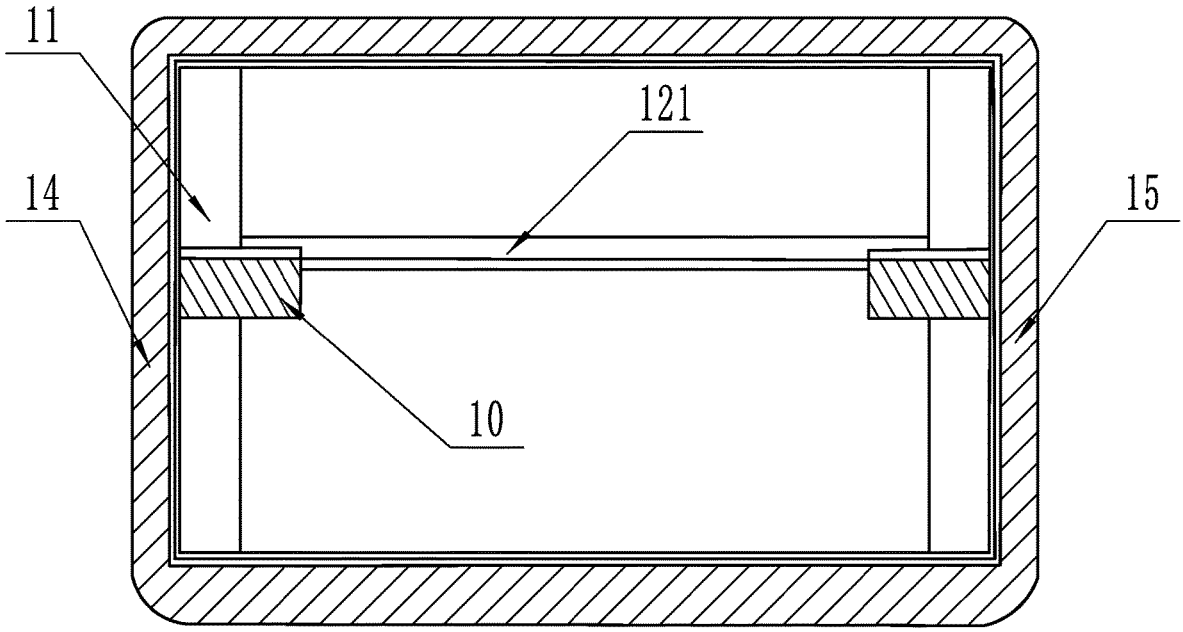
FIG. 3 is a side sectional view showing the liquid-stabilizing apparatus according to the present disclosure installed in the liquid cargo tank.
Figure 4:
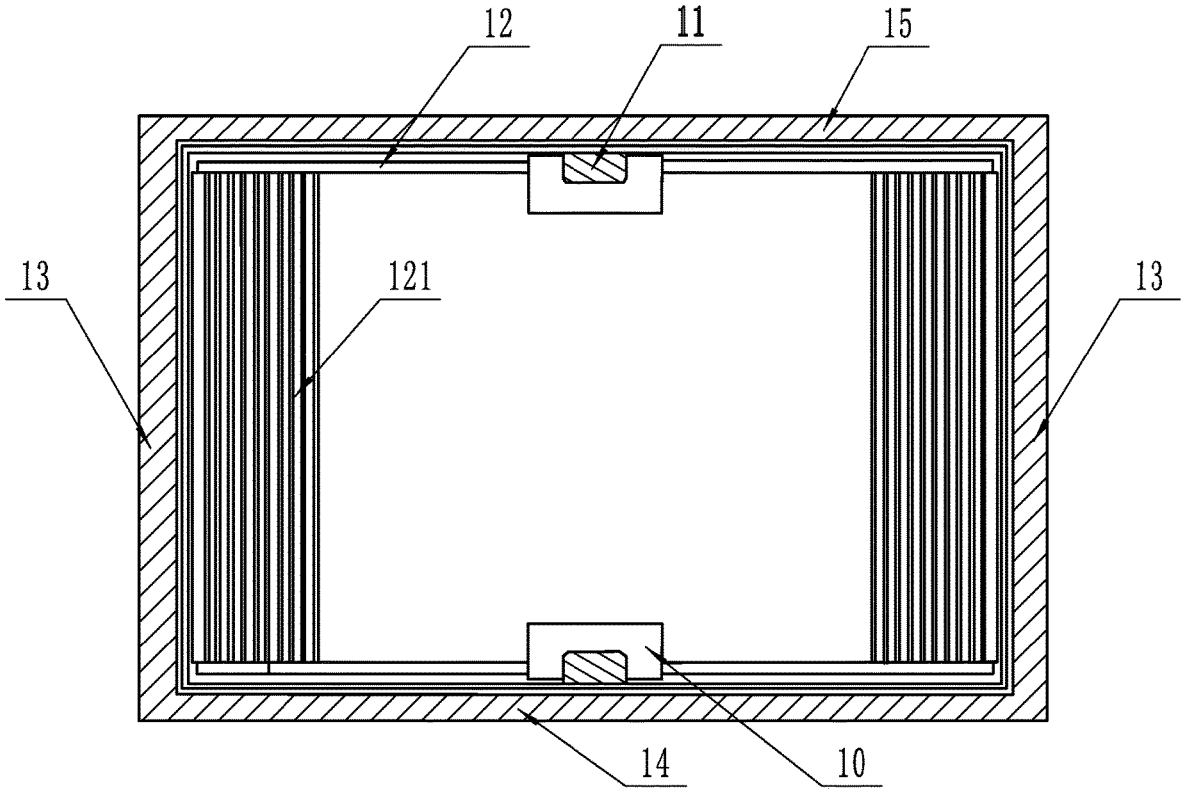
FIG. 4 is a top sectional view showing the liquid-stabilizing apparatus according to the present disclosure installed in the liquid cargo tank.

Referring to FIG. 2, FIG. 3 and FIG. 4, the liquid-stabilizing apparatus for use in the liquid cargo tank may include the guide structure 11 and the anti-sloshing members 12. The guide structure 11 is fixedly installed on a front wall 14 and a rear wall 15 of the cargo tank, and includes the positioning floating body 10 having buoyancy. The buoyancy allows the positioning floating body 10 to rise to a surface of stored liquid, while the anti-sloshing members 12 restrained by the positioning floating body are kept on a liquid surface by means of the positioning floating body 10 so as to inhibit the sloshing of the liquid cargo. Meanwhile, restricted by the positioning floating body 10 and the guide structure 11, the anti-sloshing members 12 are kept relatively perpendicular to the side wall 13 of the cargo tank, so as to ensure a more effective relative angle at the time of inhibiting the sloshing of the liquid.

Figure 5:
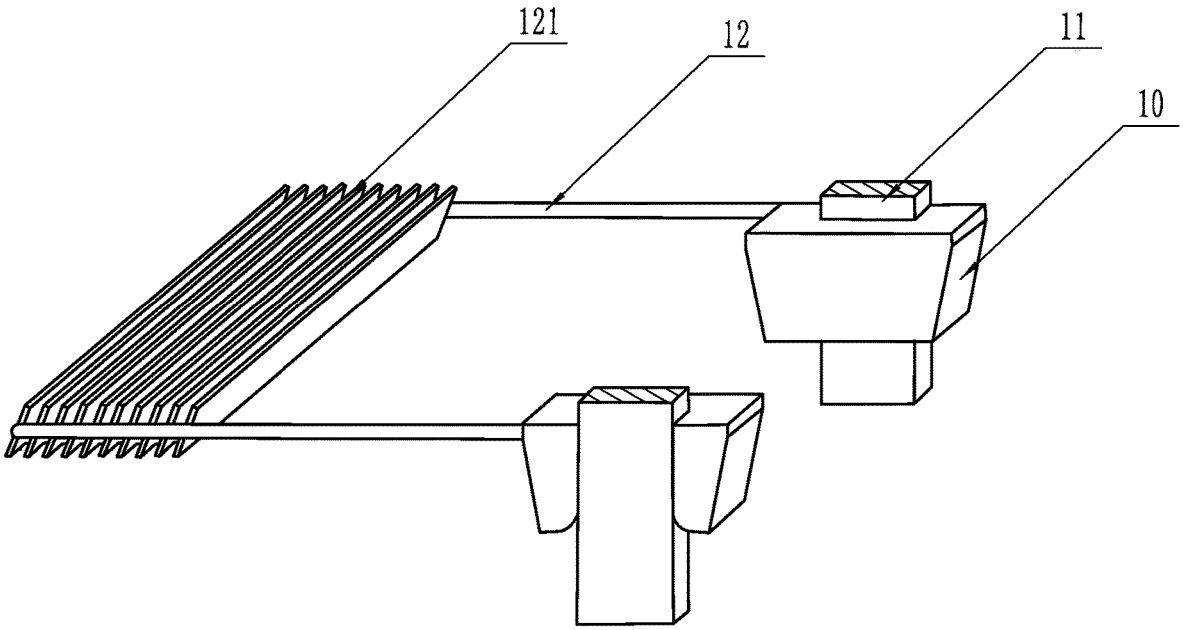
FIG. 5 is a local enlarged three-dimensional drawing of the liquid-stabilizing apparatus according to the present disclosure.

Referring to FIG. 5, the guide structure 11 may be installed on the front wall 14 and the rear wall 15 of the cargo tank, and includes: the positioning floating body 10. The positioning floating body is used to provide buoyancy so as to keep the anti-sloshing members 12 on the surface of the liquid cargo.

When the positioning floating body 10 moves up and down along the guide structure 11, an inner surface of the positioning floating body 10 may frequently contact with an outer surface of the guide structure 11. Polytetrafluoroethylene is coated on the inner surface of the positioning floating body 10 or the outer surface of the guide structure 11 to reduce friction caused by the contact between the positioning floating body 10 and the guide structure 11.

In the embodiment, the positioning floating body 10 may be made of metal or fiberglass which has very low deformation rate at low temperature. Sufficient buoyancy is produced through the proper shape of the positioning floating body 10. As long as the positioning floating body can produce sufficient buoyancy to keep the entire anti-sloshing impact apparatus above the liquid cargo, any material or shape is applicable.

Referring to FIG. 5, the anti-sloshing members 12 applied in the embodiment may be provided with discontinuous baffles 121 at a fixed angle a. The baffles have the fixed angle and proper spacing. The shapes of the baffles are not limited to specific shapes such as rectangle and oval. As long as the baffles can inhibit the flow of the liquid cargo during the movement of the liquid cargo, any shape is applicable.

If the anti-sloshing members 12 are formed into structures with the above baffles, the size of movement resistance of fluid can be adjusted by changing the sizes of the baffles, the thickness forming the baffles, and the angle and the spacing of the baffles; and sloshing attenuation efficiency of the anti-sloshing members 12 and the strength of the anti-sloshing members 12 can be set properly. Therefore, the present embodiment can inhibit the sloshing more effectively according to the capacity and the form of the cargo tank and the kind of the stored cargo.

As another example, although not shown in the figure, the anti-sloshing members 12 may be made of material having smaller specific gravity than the liquefied gas. In this case, the positioning floating body 10 in the above example can be reduced, and the anti-sloshing members 12 can float on the surface of the liquid cargo in different modes from those in the embodiments of the present.

We claim:

1. A liquid-stabilizing apparatus for a liquid cargo tank, comprising a guide structure, wherein the guide structure is provided with a positioning floating body; the positioning floating body is provided with anti-sloshing members; and the anti-sloshing members are provided with discontinuous baffles at a fixed angle relative to a plane of the anti-sloshing members; wherein the fixed angle is 25-65 degrees.

2. The liquid-stabilizing apparatus according to claim 1, wherein the positioning floating body is capable of moving up and down on the guide structure.

3. The liquid-stabilizing apparatus according to claim 1, wherein the anti-sloshing members are disposed on two sides of the positioning floating body; and the anti-sloshing members are perpendicular to the guide structure.

4. The liquid-stabilizing apparatus according to claim 3, wherein the discontinuous baffles and the anti-sloshing members are disposed in a same horizontal plane.

5. The liquid-stabilizing apparatus according to claim 4, wherein the positioning floating body is made of metal or fiberglass.

6. The liquid-stabilizing apparatus according to claim 5, wherein the guide structure is a rectangular column.

7. The liquid-stabilizing apparatus according to claim 6, wherein the discontinuous baffles are arranged with a same spacing.

* * * * *